US006918333B2

(12) United States Patent
Oshita

(10) Patent No.: US 6,918,333 B2
(45) Date of Patent: Jul. 19, 2005

(54) RETAINER DEVICE FOR A PRESS PUNCH

(75) Inventor: Ikuo Oshita, Hiroshima (JP)

(73) Assignee: Press Center Inc., Hiroshima (JP)

( * ) Notice: Subject to any disclaimer, the term of this patent is extended or adjusted under 35 U.S.C. 154(b) by 0 days.

(21) Appl. No.: 10/625,556

(22) Filed: Jul. 24, 2003

(65) Prior Publication Data

US 2004/0144230 A1 Jul. 29, 2004

(30) Foreign Application Priority Data

Oct. 7, 2002 (JP) ..... 2002-293260

(51) Int. Cl.[7] ..... B21D 28/24; B26D 7/26
(52) U.S. Cl. ..... 83/698.61; 83/684
(58) Field of Search ..... 83/698.61, 684

(56) References Cited

U.S. PATENT DOCUMENTS 5,884,546 A * 3/1999 Johnson ..... 83/530
6,170,375 B1 * 1/2001 Fidziukiewicz ..... 83/627
6,182,545 B1 * 2/2001 Janek, Jr. ..... 83/13

FOREIGN PATENT DOCUMENTS

JP 2001-18017 A 1/2001

* cited by examiner

*Primary Examiner*—Charles Goodman
(74) *Attorney, Agent, or Firm*—Donald R. Studebaker; Nixon Peabody, LLP

(57) ABSTRACT

Disclosed is a retainer device A for selectively changing the amount of projection of a punch 1 so that the punch projection amount is increased when the punch 1 is used for pressworking and, conversely the punch projection amount is decreased when the punch 1 is not used for pressworking In the retainer device A, guide pins 23 mounted on a cam 21 are moved in guide grooves 11 of a cam receiver 9 fastened to a punch holding body 2 so that the punch holding body 2 is forcibly moved up and down thereby causing the position of the punch 1 to switch between a use position and a non-use position.

2 Claims, 3 Drawing Sheets

RETAINER DEVICE FOR A PRESS PUNCH

TECHNICAL FIELD

The present invention relates to a press-punch retainer device.

BACKGROUND ART

Such a type of press-punch retainer device is the device intended for selecting, from among a plurality of punch-die sets mounted on a single press machine for sheet metal processing, a particular set of punch-dies to be used according to the type of workpiece. In other words, the amount of projection of a punch, selected for processing, from the retainer device is increased, whereby the selected punch is brought into abutment against a workpiece. On the other hand, the amount of projection of the remaining non-selected punches is reduced, whereby none of them are brought into abutment against the workpiece.

One such retainer device is disclosed in Japanese Patent Kokai Publication No. (2001)18017. This retainer device comprises: a punch holding body for holding a punch; a retainer block to which the punch holding body is interfitted movably in a vertical direction; a spring for biasing the punch holding body into a non-use position of decreasing the amount of projection of the punch; a cam plate having at its forward end a cam part which is brought into abutment against the punch holding body; and a cylinder device by which the cam plate is drawn backward and forward in a horizontal direction. The cam plate is connected, at its base end, to the forward end of a piston rod of the cylinder device via a support.

When the cam plate is drawn forward, a cam part at the forward end of the cam plate comes into abutment against an inclined surface of the punch holding body and slides on the inclined surface, whereby the punch holding body is depressed downward in opposition to the biasing force of the spring. As the result of this, the amount of projection of the punch from the retainer block is increased. On the other hand, when the cam plate is brought backward, the punch holding body is brought into its original position by the biasing force of the spring. As the result of this, the amount of projection of the punch is decreased.

In the above-described retainer device, the punch holding body is so biased by the spring as to be brought back to its non-use position. However, the spring may get twisted by deterioration or due to frictional force developed by friction between the punch holding body and the retainer block. In such a case, there is the possibility that the punch holding body remains descended even when the cam plate is brought backward and, as a result, the punch fails to return to the non-use position. Accordingly, if pressworking is carried out when a punch unnecessary for processing is not yet brought back to the non-use position, this gives rises to the problem that a workpiece is damaged therefore resulting in the production of a defective product.

DISCLOSURE OF INVENTION

The present invention provides a retainer device, for a press punch, capable of selectively changing the amount of projection of the punch whereby the amount of projection of the punch is increased when the punch is used for pressworking and, conversely, the amount of projection of the punch is decreased when the punch is not used for pressworking, the retainer device comprising:

a punch holding body for holding the punch, a retainer block for movably supporting the punch holding body so that the punch holding body is allowed to freely move between a use position of increasing the amount of projection of the punch and a non-use position of decreasing the amount of projection of the punch, and a cam which is so activated as to be drawn backward and forward, wherein:

a pin is projectingly formed in either one of the cam and the punch holding body, and either a guide groove or a guide slotted aperture for the guiding of the pin is formed in the other of the cam and the punch holding body whereby the punch holding body moves to the use position when the cam executes either one of forward movement and backward movement and, conversely, the punch holding body moves to the non-use position when the cam executes the other movement.

As a result of such arrangement, the pin is guided either to the guide groove or to the guide slotted aperture by the either one of the forward and backward movements of the cam, and the punch holding body is forcibly moved to the use position of increasing the amount of projection of the punch. On the other hand, the pin is guided either to the guide groove or to the guide slotted aperture by the other movement of the cam, and the punch holding body is forcibly moved to the non-use position of decreasing the amount of projection of the punch.

In the prior art, even when the cam is moved, the punch holding body may remain still in a lowered state therefore failing to move to the non-use position. As a result, workpieces get scratched, in other words defective products are produced. The present invention provides solutions to this problem.

Preferably, the retainer device of the present invention further comprises a biasing means operable to bias the punch holding body to the non-use position of decreasing the amount of projection of the punch. Because of this, the punch holding body is moved smoothly to the non-use position from the use position.

BEST MODE FOR CARRYING OUT THE INVENTION

Figure 1:
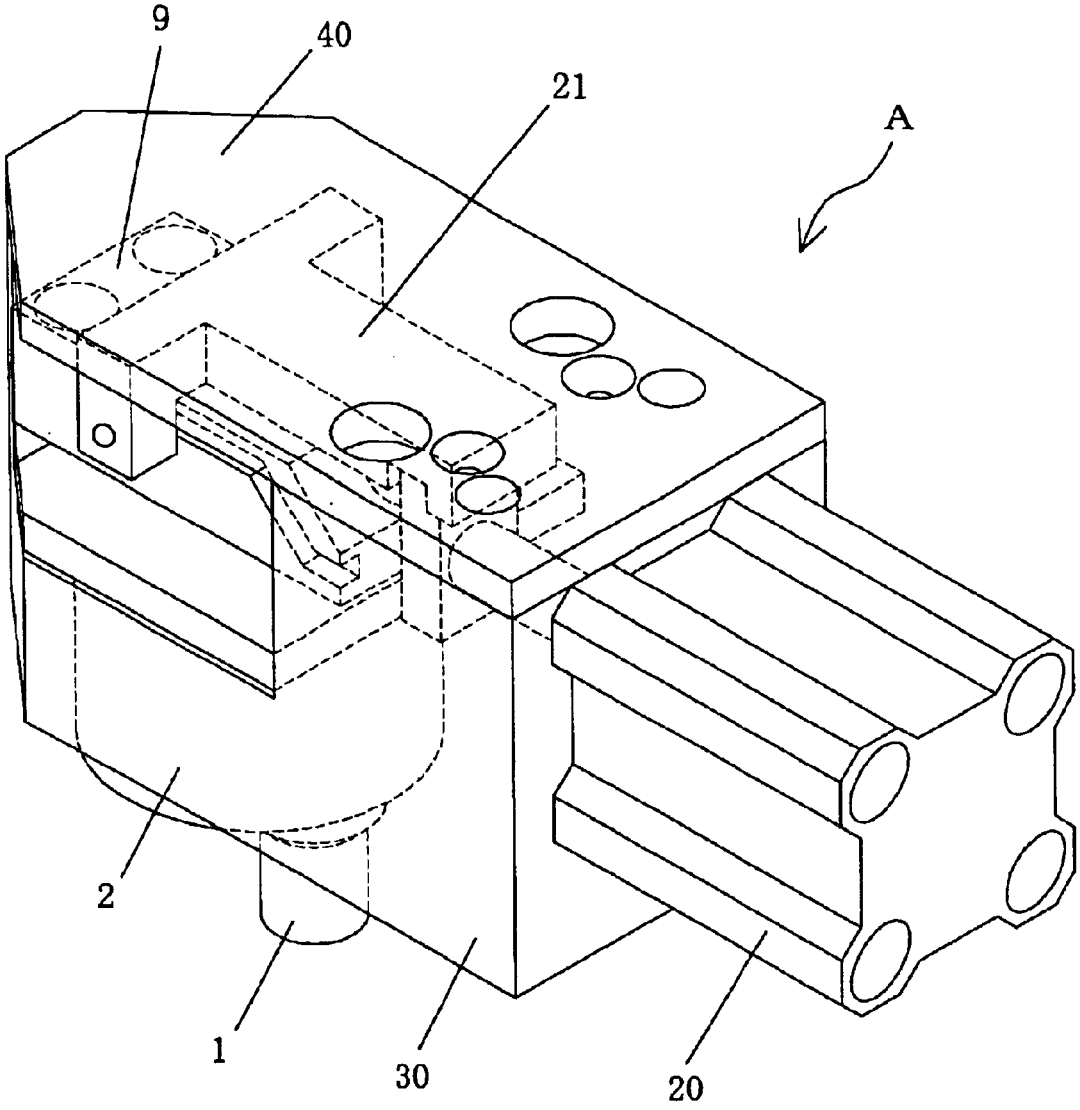
FIG. 1 is a perspective illustration of a retainer device according to an embodiment of the present invention.

Hereinafter, a preferable embodiment of the present invention will be described with reference to the drawing figures.

Structure

Referring to FIG. 1, there is shown a retainer device A for a press punch. Reference numeral 1 represents a punch. Reference numeral 2 represents a punch holding body for holding the punch 1. Reference numeral 30 represents a retainer block for supporting thereon the punch holding body 2 in such a way that the punch holding body 2 is drawn backward and forward in a free manner in the direction in which the punch 1 projects. Reference numeral 21 represents a cam by which the punch holding body 2 is drawn backward and forward. Reference numeral 9 represents a cam receiver fastened to the punch holding body 2 and serving as a surface for receiving the cam 21. Reference numeral 20 represents a cylinder device by which the cam 21 is drawn backward and forward in a direction orthogonal to the direction in which the punch holding body 2 is drawn backward and forward. Reference numeral 40 represents a backing plate providing a covering over an upper surface of the retainer block 30.

Figure 2:
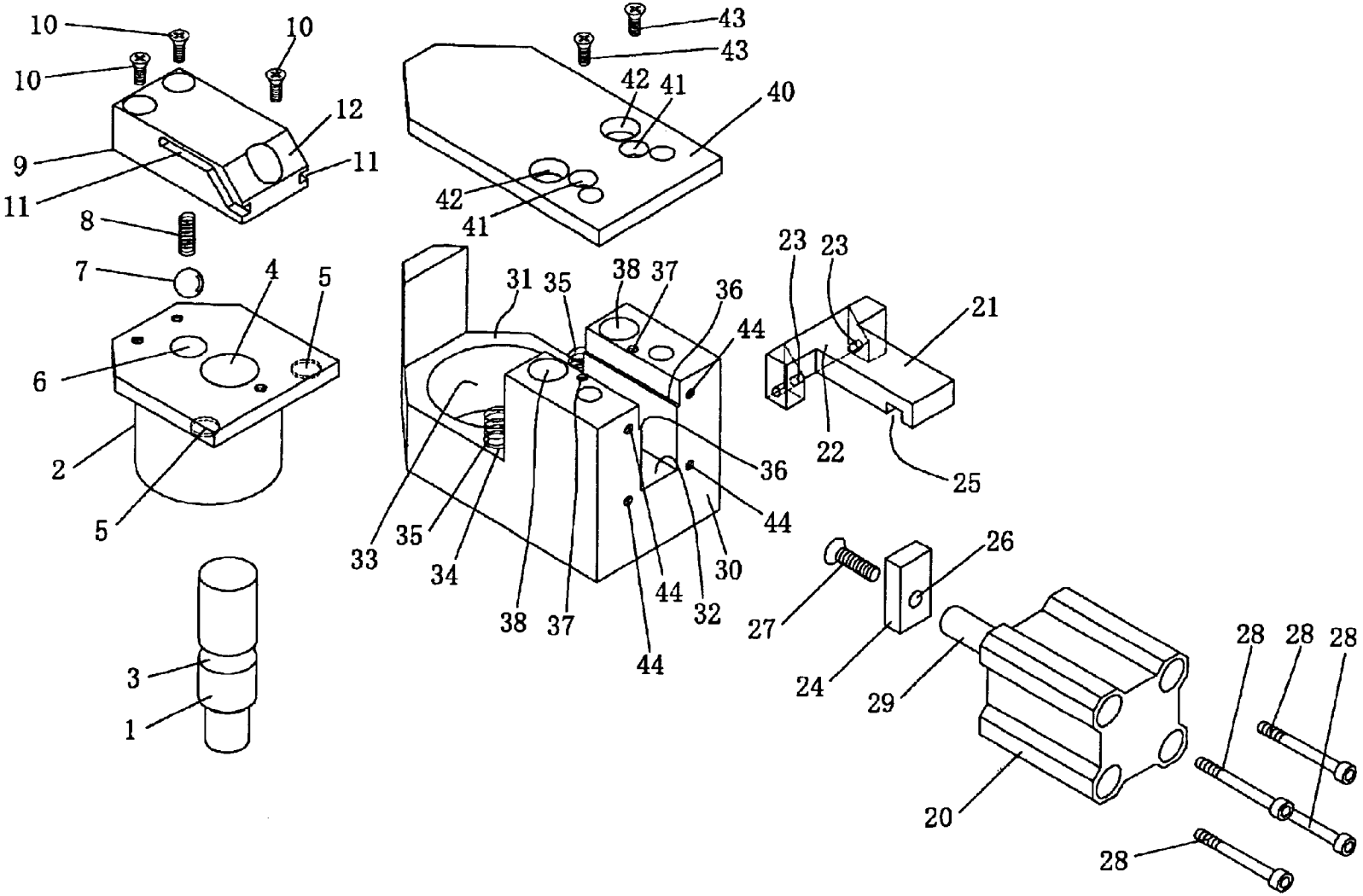
FIG. 2 is an exploded perspective illustration of the retainer device.

As shown in FIG. 2, a stepped part 3 is formed in the punch 1. The punch holding body 2 has a punch holding aperture 4 into which the punch 1 is inserted from beneath. Circular spring receiving apertures 5, 5 are formed in positions of a lower surface of the punch holding body 2 on either side of the punch holding aperture 4 and nearer to the rear, i.e., in positions nearer to the side of the cylinder device 20. Additionally, the punch holding body 2 has a punch holder insertion aperture 6 which extends diagonally toward the punch holding aperture 4 from a position of an upper surface of the punch holding body 2 in front of the punch holding aperture 4 and communicates with the punch holding aperture 4 (see FIG. 3). Inserted into the punch holder insertion aperture 6 are a punch holder 7 which is caught in the stepped part 3 of the punch 1 so that the punch 1 is fixed in the punch holding aperture 4 and a spring 8 which presses the punch holder 7 from above so as to hold the punch holder 7.

The cam receiver 9 is provided with screw insertion apertures for insertion of screws 10, 10, 10. The cam receiver 9 is fastened to the upper surface of the punch holding body 2 with the screws 10, 10, 10. Guide grooves 11, 11 are formed respectively in side surfaces of the cam receiver 9. These guide grooves 11, 11 extend horizontally from the rear end of the cam receiver 9 to the front, then incline upward diagonally to the front, and extend horizontally to the front. Furthermore, formed in an upper surface rear part of the cam receiver 9 is an inclined surface 12 which inclines downward to the rear, and the cam 21 slides on the inclined surface 12. Additionally, the spring 8 is pressed down by a lower surface of the cam receiver 9, whereby the punch holder 7 is held at the bottom of the punch holder insertion aperture 6 by the spring 8 depressed by the cam receiver 9 (see FIG. 3).

Formed in a lower surface of the cam 21 on the forward end side thereof is a cam part 22 which inclines diagonally upward toward the front. Furthermore, the cam 21 has projecting parts projecting downward from both sides of the cam part 22, and guide pins 23, 23 projecting inward are mounted on surfaces of the projecting parts which face each other. These guide pins 23, 23 are inserted respectively into the guide grooves 11, 11 of the cam receiver 9. As a result of such arrangement, when the cam 21 is drawn backward and forward, this causes the guide pins 23, 23 to travel in the guide grooves 11, 11, whereby the cam receiver 9 is forcibly moved vertically.

Furthermore, an interfitting groove 25, which extends laterally and to which a cam support 24 is interfitted, is formed in a rear end lower surface of the cam 21. The cam support 24 described here is shaped like a rectangular parallelepiped having a smaller width than the width of the cam 21. The interfitting groove 25 of the cam 21 is detachably interfitted to an upper end of the cam support 24. In such an interfitting state both sides of the cam 21 laterally project beyond the cam support 24.

A screw insertion aperture 26 is formed in the cam support 24 in such a way that it passes completely through the cam support 24 in the direction in which the cam 21 is drawn backward and forward. This screw insertion aperture 26 is for insertion of a screw 27 by which the cam support 24 is firmly secured to a front surface of a piston rod 29 of the cylinder device 20. The screw 27 is a countersunk head screw whose top face is flat, and an opening part of the screw insertion aperture 26 in the cam support 24, i.e., a bearing surface, is also countersunk.

A front end of the retainer block 30 projects in a form of a triangle or trapezoid. Formed in a front part of the retainer block 30 is a punch holding body recessed part 31 to which the punch holding body 2 is interfitted vertically movably. On the other hand, formed in a rear part of the retainer block 30 is a guide groove 32 to which the cam 21 and cam support 24 are interfitted in such a manner that they are drawn backward and forward in the guide groove 32.

The punch holding body recessed part 31 of the present embodiment, which opens in the upper surface of the retainer block 30, is formed into a lateral groove shape having openings in both side surfaces of the retainer block 30 and extending in a horizontal direction (i.e., in a direction orthogonal to the cam backward/forward direction). A punch holding body aperture 33 is opened centrally at the bottom of the punch holding body recessed part 31. Spring insertion apertures 34, 34 associated with the spring receiving apertures 5, 5 are formed at positions on the right and left sides of the punch holding body aperture 33 and nearer to the rear. Return springs 35, 35 are inserted to the insertion apertures 34, 34, respectively. As the return springs 35, 35, for example ball plungers or the like may be used in addition to compression springs. The punch holding body aperture 33, to which the punch holding body 2 is interfitted movably in a vertical direction, passes vertically through the retainer block 30.

The guide groove 32 is opened in the upper surface of the retainer block 30. An front end of the guide groove 32 opens to the punch holding body recessed part 31 and a rear end thereof opens in a rear surface of the retainer block 30. Guide stepped parts 36, 36 are formed in both side surfaces of the guide groove 32 so that the groove width becomes greater at the upper part of the guide groove 32. In other words, the narrow-width lower part of the guide groove 32 is where the cam support 24 is drawn backward and forward. On the other hand, the greater-width upper part of the guide groove 32 is where the cam 21 is drawn backward and forward. The guide stepped parts 36, 36 receive the portions of the cam 21 laterally projecting beyond the cam support 24, whereby the backward/forward movement of the cam 21 is guided while preventing the cam 21 from assuming a front-down orientation.

Opened in upper surface areas of the retainer block 30 on both sides of the guide groove 32 are screw apertures 37, 37 for fixing the backing plate 40 to the retainer block 30, and counterbored apertures 38, 38 into which bolts are inserted from the lower surface of the retainer block 30. Formed in the backing plate 40 are countersunk apertures 41, 41 corresponding to the screw apertures 37, 37, and screw apertures 42, 42 corresponding to the counterbored apertures 38, 38. The backing plate 40 is fastened to the retainer block 30 by application of countersunk screws 43, 43 to the screw apertures 37, 37 via the countersunk apertures 41, 41 as well as by applying bolts (not shown) to the screw apertures 42, 42 via the counterbored apertures 38, 38 from beneath the retainer block 30. Additionally, screw apertures 45, 45, 45, 45 for the attachment of the cylinder device 20 to the retainer block 30 are opened in the rear surface of the retainer block 30. The cylinder device 20 is fastened to the retainer block 30 with bolts 28, 28, 28, 28.

The punch holding body 2 is, with the punch 1 inserted thereinto and held therein, vertically movably interfitted to the punch holding body recessed part 31 of the retainer block 30 while at the same time being biased upwardly by the return springs (compression springs) 35, 35. The cam 21 is interfitted, via the interfitting groove 25, to an upper end of the cam support 24 secured to the front surface of the piston rod 29 of the cylinder device 20 and is slidably supported on the guide stepped parts 36, 36 of the guide groove 32.

Furthermore, the backing plate 40, fixed to the retainer block 30, controls both the rise end position (i.e., the non-use position) of the punch holding body 2 and the upper surface height of the cam 21. In other words, the height from the guide stepped parts 36, 36 of the guide groove 32 up to the upper surface of the retainer block 30 is substantially the same as the height of the cam 21. Therefore, the lower surface of the backing plate 40 serves as a guide surface by which the cam 21 is drawn backward and forward without upward floating.

Operation and the Like

Figure 3A:
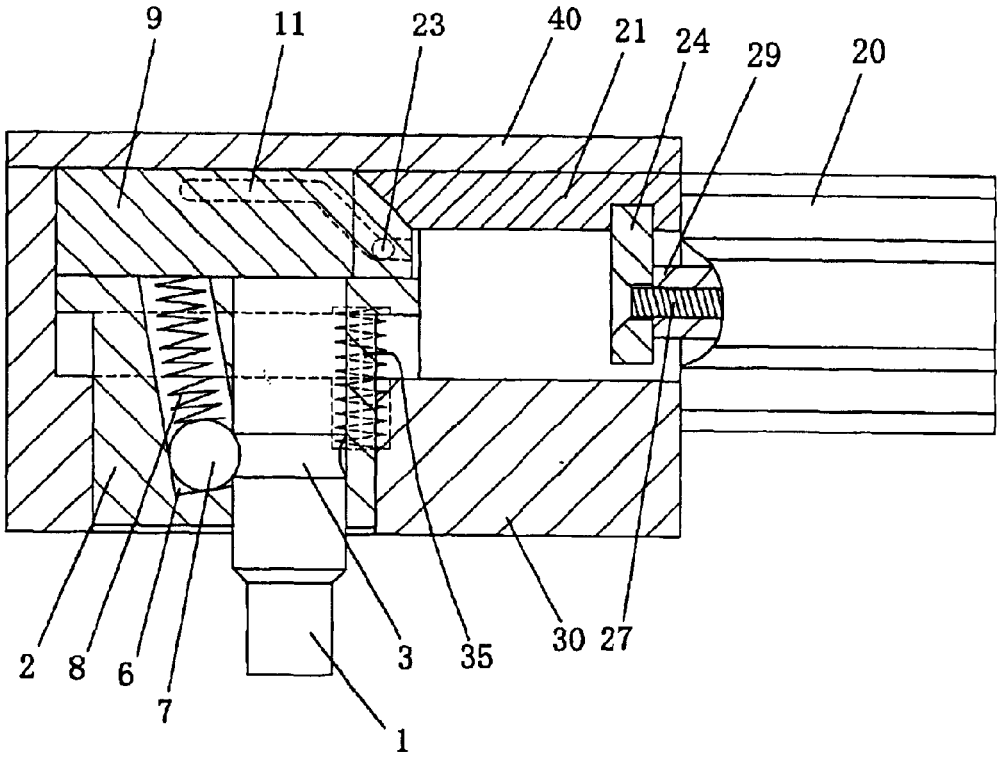
FIG. 3A is a longitudinal cross sectional view of the retainer device when the punch moves to the non-use position.

Referring to FIG. 3A, there is shown a non-use state in which the amount of projection of the punch 1 from the retainer block 30 is small. Stated another way, the cam 21 is drawn backward by the cylinder device 20 so that the cam 21 is placed at the backward end. As a result, the guide pins 23 of the cam 21 are located at the front ends of lower horizontal parts of the guide grooves 11 of the cam receiver 9 and the punch holding body 2 is biased upward by the return springs 35 and is located in the non-use position. Additionally, the cam part 22 on the forward end side of the cam 21 is in abutment against the rear inclined surface 12 of the cam receiver 9 fastened to the punch holding body 2.

Figure 3B:
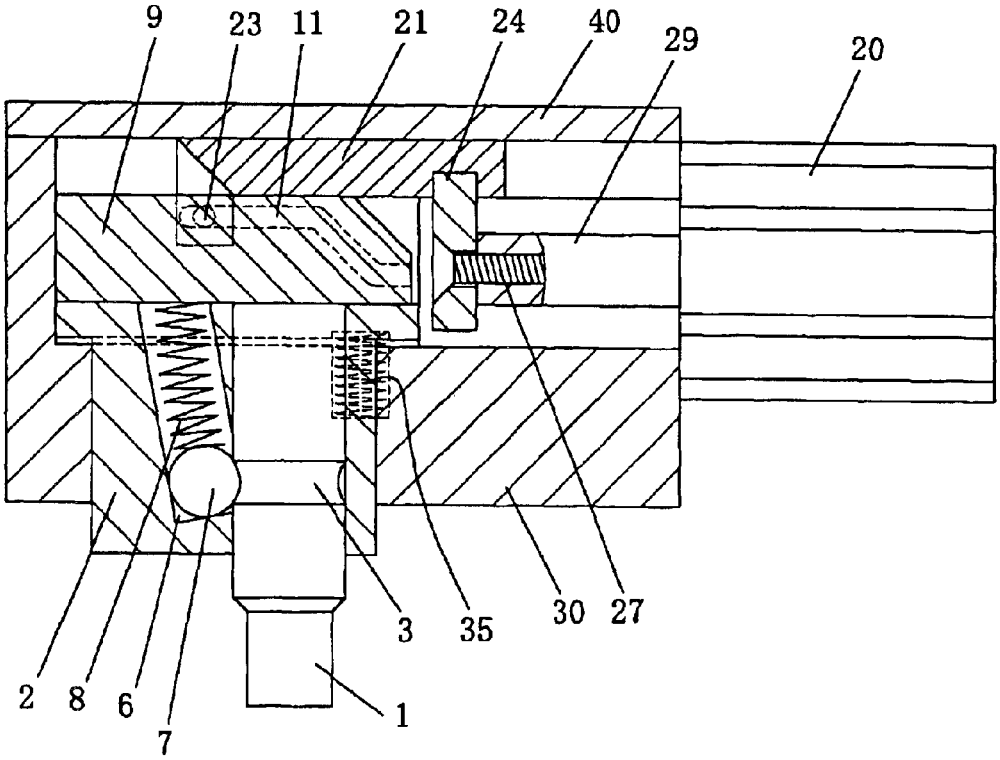
FIG. 3B is a longitudinal cross sectional view of the retainer device when the punch moves to the use position.

When the cam 21 is drawn forward by the cylinder device 20 in the above state, the cam part 22 at the forward end of the cam 21 slides on the rear inclined surface 12 of the cam receiver 9 and, at the same time, the guide pins 23 of the cam 21 move on inclined parts of the guide grooves 11 toward the front. Since the cam 21 is so regulated by the backing plate 40 as to move horizontally, the cam receiver 9 is depressed when the cam part 22 advances. As a result, the punch holding body 2 descends against the biasing force of the return springs 35 and then moves to the use position as shown in FIG. 3B. Even after the punch holding body 2 is lowered, the cam 21 continues to move forward on the cam receiver 9 and enters, at its forward end, the state of holding the punch holding body 2 in the use position via the cam receiver 9.

When the cam 21 is drawn backward by the cylinder device 20, the punch 1 is brought back again to the non-use position. At this time, the guide pins 23 of the cam 21 move to the rear in the guide grooves 11 of the cam receiver 9 and move downward on the inclined parts of the guide grooves 11. By virtue of the movement of the guide pins 23, the cam receiver 9 is forcibly pulled upward together with the punch holding body 2, and the punch holding body 2 returns to the non-use position. Since the punch holding body 2 is biased upward by the return springs 35, this allows the punch holding body 2 to smoothly return to the non-use position.

Such arrangement prevents the punch holding body 2 from remaining lowered, when the cam 21 is drawn backward. In other words, it is ensured that the punch 1 is shifted to the non-use position without fail, thereby preventing the production of defective products.

In the present embodiment, the guide grooves 11 are formed in the cam receiver 9 fastened to the punch holding body 2 and the guide pins 23 are projectingly formed in the cam 21. However, the present invention is not limited to such an embodiment. For example, it is possible to employ such a structure that guide grooves are formed in side surfaces of a cam and guide pins are projectingly formed in a cam receiver, as long as the punch holding body 2 executes a vertical motion relative to the backward/forward movement of the cam 21 as in the present embodiment.

Furthermore, in the foregoing embodiment it is arranged such that when the cam 21 is drawn backward the punch holding body 2 assumes the non-use position. Alternatively, it may be arranged such that the punch holding body 2 assumes the use position when the cam 21 is drawn backward and assumes the non-use position when the cam 21 is drawn forward.

Further, in order to allow the guide pins to move smoothly in the guide grooves it may be arranged such that the guide pins are rotatably supported on the cam or cam receiver via a bearing.

Furthermore, in the foregoing embodiment the cam 21 is supported, at its both sides, on the guide stepped parts 36, 36. Accordingly, even in the case of the employment of an arrangement that the cam part 22 of the cam 21 is drawn away from the cam receiver 9 fastened to the punch holding body 2 at the backward end of the cam 21, the cam 21 is not placed front down. In other words, although the arrangement that the base end of the cam 21 is merely interfitted to the cam support 24 facilitates loading and unloading of the cam 21, the cam 21 is likely to be placed front down in such an arrangement. On the other hand, for the case of the present embodiment the guide stepped parts 36, 36 prevent the cam 21 from being placed front down. This ensures that when the cam 21 is drawn forward the cam part 22 of the cam 21 comes into abutment against the rear inclined surface 12 of the cam receiver 9 fastened to the punch holding body 2, thereby making it possible for the punch holding body 2 to move to the use position.

Further, in the foregoing embodiment it is arranged such that when the cam 21 is positioned at the backward end the cam part 22 of the cam 21 is hooked on the rear inclined surface 12 of the cam receiver 9 fastened to the punch holding body 2. Accordingly, even when the guide stepped parts 36, 36 are not formed in the guide groove 32 it is ensured that the punch holding body 2 is moved to the use position by the cam part 22 when the cam 21 is drawn forward.

Furthermore, in the foregoing embodiment the screw 27 for fixing the cam support 24 to the piston rod 29 is a countersunk head screw, so that the head of the screw 27 does not project from the front surface of the cam support 24. This is the advantage for reducing the size of the retainer device A. In other words, even when the cam 21 is positioned at the forward end, there is no problem of interference between the head of the screw 27 and the punch holding body 2. This makes it possible to allow the cam support 24 to approach as nearer as possible to the vicinity of the rear end of the punch holding body 2. Accordingly, there is no need to extend the length of the cam 21 more than necessary, which provides an advantage for the above-mentioned downsizing.

What is claimed is:

1. A retainer device, for a press punch, capable of selectively changing the amount of projection of said punch whereby the amount of projection of said punch is increased when said punch is used for pressworking and, conversely, the amount of projection of said punch is decreased when said punch is not used for pressworking, the retainer device comprising:

a punch holding body for holding said punch, a retainer block for movably supporting said punch holding body so that said punch holding body is allowed to freely move between a use position of increasing the amount of projection of said punch and a non-use position of decreasing the amount of projection of said punch, and a cam which is so activated as to be drawn backward and forward, wherein:

a pin is projectingly formed in either one of said cam and said punch holding body, and either a guide groove or a guide slotted aperture for the guiding of said pin is formed in the other of said cam and said punch holding body whereby said punch holding body moves to said use position when said cam executes either one of forward movement and backward movement and, conversely, said punch holding body moves to said non-use position when said cam executes the other movement.

2. The press-punch retainer device of claim 1 further comprises biasing means operable to bias said punch holding body to said non-use position of decreasing the amount of projection of said punch.

* * * * *